US005306195A

United States Patent [19]

Hayashi

[11] Patent Number: 5,306,195

[45] Date of Patent: Apr. 26, 1994

[54] WATER-PROOF CONNECTOR

[75] Inventor: Hiroyuki Hayashi, Yokkaichi, Japan

[73] Assignee: Sumitomo Wiring Systems, Ltd., Yokkaichi, Japan

[21] Appl. No.: 989,132

[22] Filed: Dec. 11, 1992

[30] Foreign Application Priority Data

Dec. 21, 1991 [JP] Japan ..... 3-105577

[51] Int. Cl.[5] ..... H01R 13/40

[52] U.S. Cl. ..... 439/587; 439/467

[58] Field of Search ..... 439/271, 274, 278, 281-283, 439/586, 587, 588, 589, 467, 595-598, 603, 752

[56] References Cited

U.S. PATENT DOCUMENTS 4,311,355 1/1982 Plyler et al. .
4,776,813 10/1988 Wilson et al. ..... 439/587
5,076,806 12/1991 Hotea et al. ..... 439/587 X
5,122,081 6/1992 Bogiel et al. ..... 439/595 X

FOREIGN PATENT DOCUMENTS 0048930 4/1982 European Pat. Off. .
4015793 12/1990 Fed. Rep. of Germany .

*Primary Examiner*—Neil Abrams
*Assistant Examiner*—Khiem Nguyen
*Attorney, Agent, or Firm*—Sandler, Greenblum & Bernstein

[57] ABSTRACT

A water-proof connector includes a main body with a terminal accommodating chamber provided therein, a pair of covers integrally formed through a hinge on both the sides of the rear portion of the main body which becomes the insertion side of the electric wire with the terminal adhering on it, a concave portion for forming the electric wire through opening and provided in a closed condition converging towards the respective tip end portions of the cover, a rubber sealing material mounted on the inner face of each cover to adhere on the electric wire near the tip end portion, and engaging elements in a cover closed condition.

2 Claims, 2 Drawing Sheets

WATER-PROOF CONNECTOR

BACKGROUND OF THE INVENTION

The present invention generally relates to a water-proof connector to be used for a wire harness or the like for motorcar use, and more particularly, to a water-proof mechanism, provided integrally with a connector main body, on an electric wire insertion side in a connector for accommodating a terminal adhered under pressure on the electric wire.

Conventionally, in a connector for accommodating, in a terminal accommodating chamber formed therein, a terminal adhered under pressure on this type of electric wire, a rubber plug 3 is mounted on the tip end portion of an electric wire W with a terminal 1 adhering under pressure against it as shown in FIG. 5 so as to effect a sealing operation of the electric wire insertion side opening. The rubber plug 3 is made to adhere on the inner face of the terminal insertion opening 4*a* of the connector 4, or is made to adhere to close the opening from outside into the terminal insertion opening.

When inundation from the opening on the above described electric wire insertion side of the connector is specially required to be prevented, grease is injected into the opening portion on the electric wire insertion side of the connector to effect the water proof operation.

In the above described water proof rubber plug 3 mounted and also, of only the grease injected, an effect with respect to the water proof is hardly provided if high-tension water is jetted into the opening on the electric wire insertion side of the connector with, for example, a high-tension washing operation being effected, with a problem in terms of reliability.

The rubber plug is likely to deteriorate subject to the high-tension water, and the connector sealing function with respect to the normal rain water or the like is also lowered.

Also, in the operationality, grease has to be injected respectively into the opening on the electric wire insertion side of each connector at the later step, with troublesome problems.

SUMMARY OF THE INVENTION

Accordingly, the present invention has been developed with a view to substantially eliminating the above discussed drawbacks inherent in the prior art and has for its essential object to provide an improved water-proof connector.

Another important object of the present invention is to provide an improved water-proof connector which is capable of positively preventing the inundation even in a case where the high-tension washing operation is effected, and a water-proof washing operation is made unnecessary at a later step, and in addition, a rubber plug for functioning as the sealing of the connector can be protected.

In accomplishing these and other objects, according to one preferred embodiment of the present invention, there is provided a water-proof connector which includes a main body with a terminal accommodating chamber provided therein, a pair of covers integrally formed through a hinge operation on both the sides of the rear portion of the main body which becomes the insertion side of the electric wire with the terminal adhering on it, a concave portion for forming the electric wire through opening and provided in a closed condition converging to the respective tip end portions of the cover, a rubber sealing material mounted on the inner face of each cover to adhere on the electric wire near the tip end portion, and an engaging operation locked in a cover closed condition.

In the preventing connector, a cylindrical portion for inserting an electric wire with a connector sealing rubber plug being mounted on the rear portion of the terminal pressure adhering portion is provided in the rear portion of the main body. It is preferable to form a pair of covers through the hinge portion in the rear portion of the cylindrical portion.

As a cover integrally formed through a hinge is provided in the rear portion of the connector main body, and the cover is open at the terminal inserting operation into the connector, the inserting operation of the terminal can be effected smoothly without any problem. As the cover is closed, locked after the insertion, and the rubber sealing material mounted on the inner face of the cover in the locked condition adheres on the whole face of the outer periphery of the electric wire, the water proof operation can be positively effected even with respect to the high-tension water.

As the rubber plug mounted on the rear portion of the terminal pressure adhering portion of the electric wire is accommodated within the cover or in the cylindrical portion provided in the rear portion of the main body, the deterioration can be prevented without the rubber plug

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
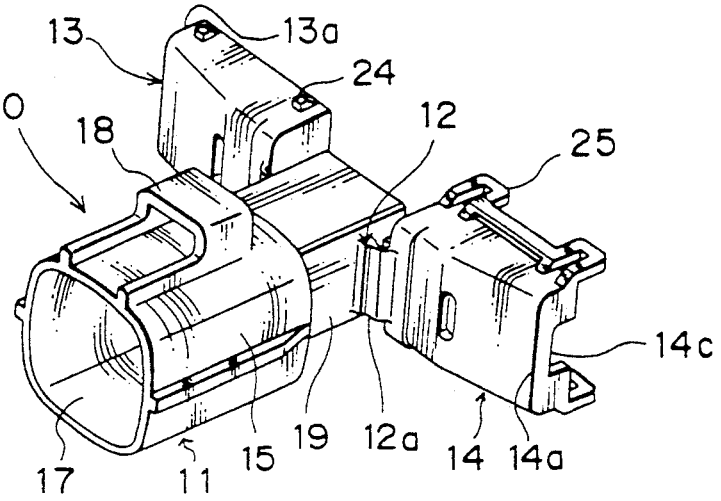
FIG. 1 is a perspective view showing an embodiment of a water-proof connector of the present invention.

Before the description of the present invention proceeds, it is to be noted that like parts are designated by like reference numerals throughout the accompanying drawings.

Figure 2:
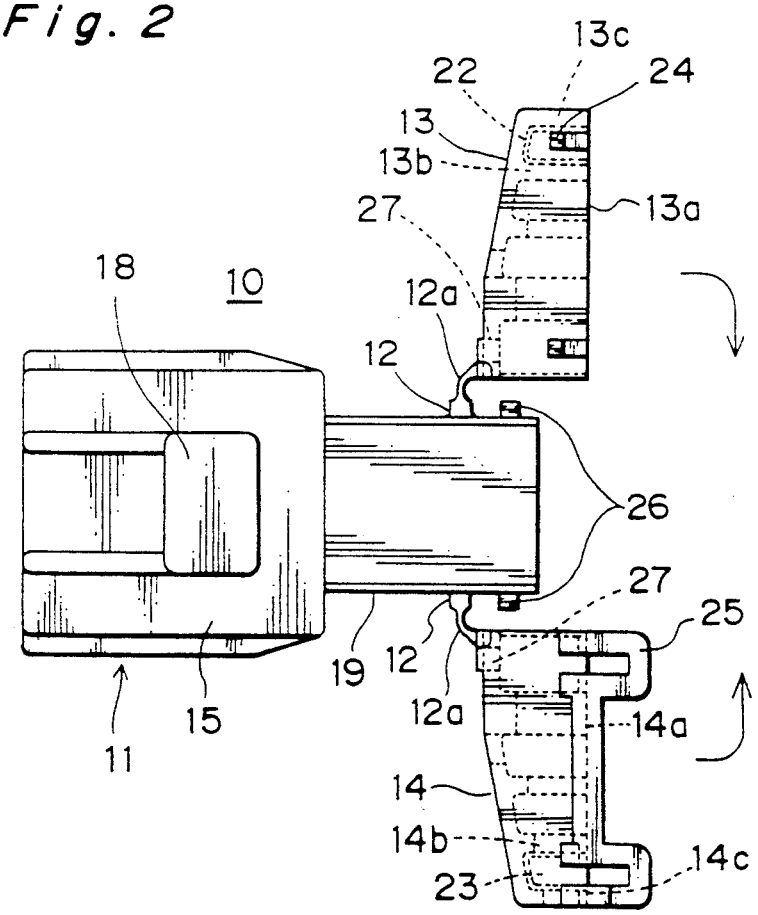
FIG. 2 is a plan view of the above described water proof connector.
Figure 3:
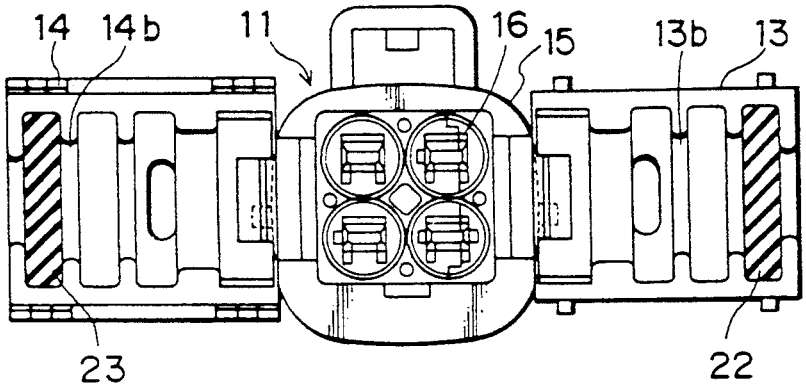
FIG. 3 is a right side view of FIG. 2.

A water-proof connector 10 is an integral molding of insulating resin as shown in FIG. 1 through FIG. 3. It is composed of a main body 11, a hinge portion 12, and a pair of covers 13, 14.

The main body 11 has four terminal accommodating chambers 16 above and below, right and left in the interior on the rear side of an approximately square cylindrical outer wall 15. The front side interior is made hollow, and is made an inserting portion 17 of a connector (not shown) on the other side. A locking portion 18 in the inserting operation of the opposite side connector is formed on the outer wall top face.

A smaller square cylindrical portion 19 is projected from the rear end face of the outer wall 15 of the above described main body 11. A pair of right, left covers 13, 14 are provided through a hinge portion 12 near the rear end of both right, left side faces 19*a* of the cylindrical portion 19. The above described hinge portion 12 is made flexible with a central portion 12*a* of a coupling member between the cylindrical portion 19 and a cover 13 or 14 being made thinner.

A pair of right, left covers 13, 14 have the square cylindrical portion half-divided among its axial direction. The inner end faces 13*a*, 14*a* are connected with each other by the rotation of the pair of right, left covers 13, 14 in a mutually approaching direction (the arrow mark direction of FIG. 2) with the above described hinge portion 12 as a support point so as to construct the continuous square cylindrical portion in the rear end of the cylindrical portion 19. The front end portion of the square cylindrical portion composed of the covers 13 and 14 is externally engaged with the rear end portion of the cylindrical portion 19 so that they are adapted to be connected without a gap.

Figure 4:
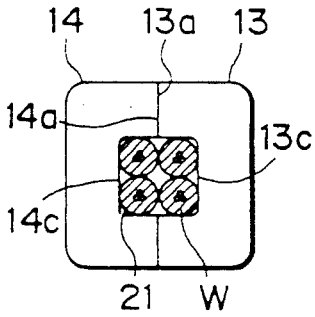
FIG. 4 (A) is a right side view in a condition where the cover of the above described water-proof connector is closed, FIG. 4 (B) is a sectional view of a sealing rubber material mounting portion, FIG. 4 (C) is a sectional view of a cylindrical portion.
Figure 4B:
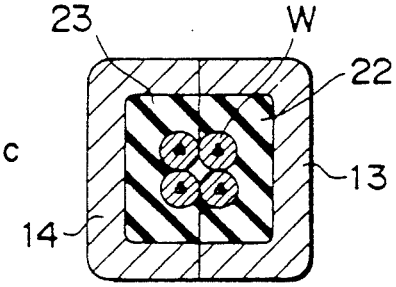
Figure 4C:
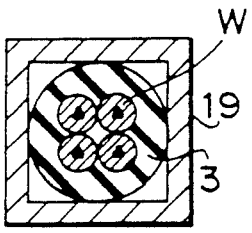

The above described covers 13, 14 are channel-shaped in cross-section as described hereinabove. They are adapted to be inclined at the rear portion side so as to form a square conical trapezoidal shape when they are connected. Opened concave portions 13*c*, 14*c* on the connection face side are formed in the center of the rear end face so as to form an electric wire through opening 21 composed of a square hole at the connecting time as shown in FIG. 4 (A). The electric wire through opening 21 is adapted to be made large enough to extend through with four electric wires W being focused in the present embodiment.

The inner face of the covers 13, 14 are reinforced with ribs 13*b*, 14*b* along the channel-shaped (cross-section) longitudinal face and the upper, lower face being formed at the given interval as shown in FIG. 2 and FIG. 3, and the rubber sealing materials 22, 23 adheres across the whole inner face between the adjacent ribs on the rear end side. These rubber sealing materials 22, 23 become annular when the rear end face has been connected with the covers 13, 14 being closed so as to adhere on the outer peripheral face of four electric wire W as shown in FIG. 4 (B).

A locking means for mutual engaging operation on a connecting condition is provided on the cover 13, 14. Namely, an engaging projection 24 is projected from both the front, rear sides of the top face of the cover 13, and an engaging groove frame 25 for inserting the above described projection 24 is projected from both the front, rear sides of the top face of the cover 14.

A positioning projection 26 is projected from both the right, left sides on the rear end side of the cylindrical portion 19 as positioning use in a condition where the covers 13, 14 are closed. A hole 27 into which the above described projection 16 is inwardly engaged is drilled in an opposite position with the covers 13, 14 being closed.

Figure 5:
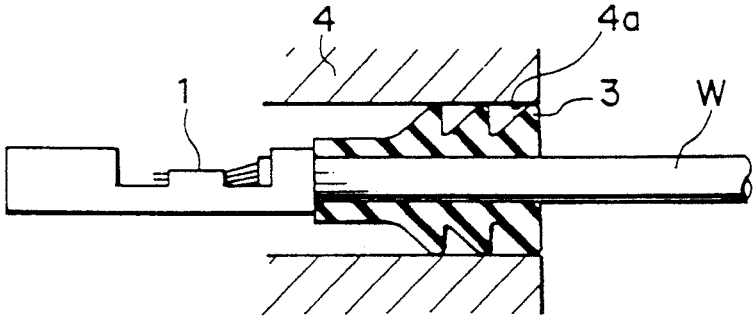
FIG. 5 is a front face view showing a condition where a rubber plug for connector sealing use is mounted on the electric wire.

When a terminal 1 adheres under pressure on the tip end shown in the above described FIG. 5 with respect to the water-proof connector of the above described construction, and an electric wire 2 with a rubber plug 3 for connector sealing use being mounted on it is mounted on the rear portion of the terminal pressure adhering portion, an electric wire W is inserted with a pair of covers 13, 14 being opened as shown in FIG. 1 though FIG. 3 so as to accommodate the terminal 1 into the terminal accommodating chamber 16 of the main body 10. A rubber plug 3 mounted on the electric wire W in this position is in contact against the inner face of the cylindrical portion 19 as shown in FIG. 4 (C).

The covers 13, 14 are rotated, closed with the hinge portion 12 as a support point in this condition. At this time, the positioning projection 26 is inserted into a hole 27 so as to effect a positioning operation and an engaging frame 25 is engaged with an engaging projection 24 so as to secure the covers 13, 14 in a closed condition.

The covers 13 and 14 are closed, and four electric wires W are inserted into the interior of the water-proof connector 10 from the electric through opening 21 as shown in FIG. 4 (A), and is made to adhere with sealing rubber materials 22, 23 as shown in FIG. 4 (B) in the inner position in contact with the wire electric through opening 21.

The electric wire through opening of the water-proof connector 10 is completely sealed by the sealing rubber materials 22 and 23. The rubber plug 3 for connector sealing use is cut off from the electric wire through opening with sealing rubber materials 22 and 23. As it is positioned within the cylindrical portion 19, the function of the connector sealing can be sufficiently retained without deterioration.

As is clear from the foregoing description, according to the arrangement of the present invention, sufficient water-proof performance can be exhibited even with respect to the high tension washing water, because a cover with a sealing rubber material being mounted integrally with the connector main body is provided.

The rubber plug for connection sealing use can be protected with the cover.

Such a troublesome operation as to inject grease is not necessary at the later step, with an advantage that the operationality is improved.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A water-proof connector comprising a main body having a terminal accommodating chamber provided therein, a pair of covers integrally connected on both respective sides of a rear portion of the main body by respective hinges for movement between an open condition and a closed condition, said rear portion being an insertion side for an electric wire with a terminal connected thereto, a concave portion on each of said pair of covers for forming an electric wire through opening, wherein in said closed condition, the respective concave portions mutually become less spaced apart from each other as they converge towards respective tip end portions of the pair of covers, a rubber sealing material mounted in said respective concave portions on an inner face of each cover to contact the electric wire near the tip end portions, and an engaging projection for locking said pair of covers in the closed condition.

2. A water-proof connector in accordance with claim 1, further comprising a cylindrical portion provided in the rear portion of the main body for inserting an electric wire with a connector sealing rubber plug, said connector sealing rubber plug being mounted on a rear portion of the terminal, and said pair of covers being connected by said respective hinges at the rear portion of the cylindrical portion.

* * * * *